US012281484B2

(12) United States Patent
Clancy

(10) Patent No.: US 12,281,484 B2
(45) Date of Patent: Apr. 22, 2025

(54) PARTITION OR BARRIER SYSTEM

(71) Applicant: Dove Clancy, San Diego, CA (US)

(72) Inventor: Dove Clancy, San Diego, CA (US)

( * ) Notice: Subject to any disclaimer, the term of this patent is extended or adjusted under 35 U.S.C. 154(b) by 426 days.

(21) Appl. No.: 17/673,056

(22) Filed: Feb. 16, 2022

(65) Prior Publication Data

US 2023/0258007 A1 Aug. 17, 2023

(51) Int. Cl.
*E04B 2/74* (2006.01)
*E04G 21/24* (2006.01)

(52) U.S. Cl.
CPC ..... *E04G 21/243* (2013.01); *E04B 2/74* (2013.01)

(58) Field of Classification Search
CPC ..... E04G 21/243; E04G 21/241; E04B 2/74; E04B 2002/7468; E04B 2002/7461; E04B 2009/7479; E04B 2/821; E04B 2025/006
USPC ..... 248/342, 343, 683, 206.5, 309.4
See application file for complete search history.

(56) References Cited

U.S. PATENT DOCUMENTS 729,505 A * 5/1903 McMurtrie ..... F21V 21/02 248/343
5,924,469 A * 7/1999 Whittemore ..... E04G 21/30 248/200.1
7,658,219 B2 2/2010 Whittemore
7,910,771 B2 * 3/2011 Dubois ..... C07C 51/252 562/545
8,152,118 B2 * 4/2012 Melic ..... E04G 21/3233 248/200.1
2004/0031892 A1 * 2/2004 Whittemore ..... E04G 21/243 248/229.16
2004/0065799 A1 * 4/2004 Whittemore ..... E04G 21/243 248/200.1
2005/0077015 A1 * 4/2005 Melino ..... E04G 21/243 160/135
2008/0185111 A1 * 8/2008 Zagone ..... E04G 21/243 248/200.1
2009/0007529 A1 * 1/2009 Tramontina ..... E04G 21/30 55/356
2010/0276090 A1 * 11/2010 Zagone ..... E04G 21/243 160/368.1
2015/0233114 A1 * 8/2015 Hoefler ..... E04B 2/7433 52/239
2018/0075785 A1 3/2018 Bernard
2020/0024858 A1 1/2020 Whittemore
2020/0087935 A1 * 3/2020 Whittemore ..... E04G 21/241
2020/0102755 A1 * 4/2020 Langtry ..... E04B 9/225

FOREIGN PATENT DOCUMENTS

WO 2012150168 A1 8/2012
WO WO-2020146862 A1 * 7/2020 ..... E04G 21/243

OTHER PUBLICATIONS

International Search Report, PCT/US2023/13108, Shane Thomas (authorized officer), mailed May 15, 2023.

* cited by examiner

*Primary Examiner* — Daniel P Cahn
*Assistant Examiner* — Matthew R. Shepherd
(74) *Attorney, Agent, or Firm* — The Buche Law Firm, PC; Bryce A. Johnson; John K Buche

(57) ABSTRACT

Disclosed is a T-block attachment with a magnetized bolt for (first) securing a plastic sheet or curtain to the mount and (second) securing the mount to a metallic grid of a paneled sealing. In a first embodiment, the T-block features a stem and two arms wherein the stem includes a pole receptacle and each arm includes both a clip receptacle and a bolt receptacle.

2 Claims, 8 Drawing Sheets

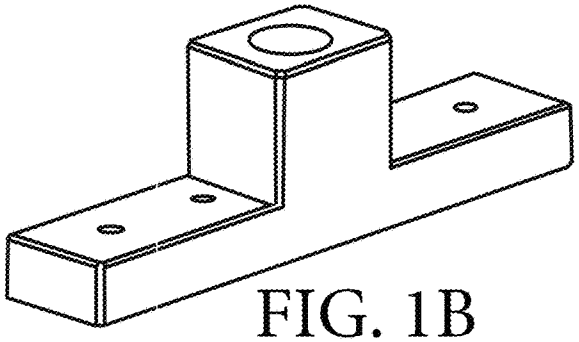
FIG. 1B
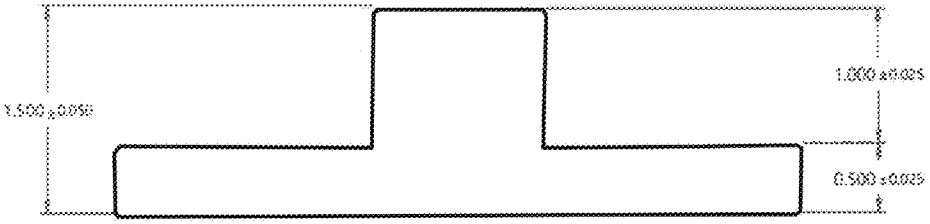
FIG. 2B
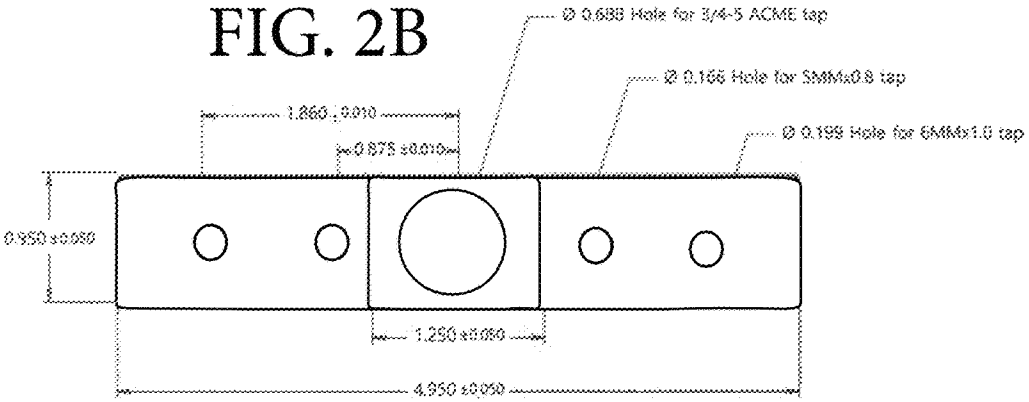
FIG.3B
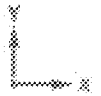

PARTITION OR BARRIER SYSTEM

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of partitioning mounting systems and devices for mounting or otherwise establishing a partition.

Background of the Invention

U.S. Pat. No. 7,658,219 (the '219 patent (incorporated by reference in its entirety)) discloses a partition mount with integral plunger assembly. According to that document, the disclosed device upholds a curtain or plastic sheet between a ceiling and a floor of a room. In one example depicted in FIGS. 11A through 11E of the '219 patent, the disclosed device essentially connects the top of a curtain or plastic sheet to the top or head of an extension pole so that the butt of the pole can be pressed into the floor while the top of the pole holds the sheet upright against the ceiling or other overhead structure. In construction zones, two or more partition devices can be used to establish a partition system or framework that is useful for protecting a clean area from a work area or construction zone i.e., via isolating the clean area of a building or room from dust, noise, light, odors and like nuisances generated in the work area or construction zone.

Unfortunately, the device disclosed by the '219 patent is suitable for establishing a partition framework or system in all rooms or buildings. In particular, some rooms have paneled ceilings where the force of the extension pole pushing upward on curtain or sheet against the ceiling is high enough to displace the ceiling's panel. When this happens, the pole can tip over and cause the partition to fail. Accordingly, a need exists for devices that are suitable for establishing a partition framework or system in rooms or buildings with paneled or otherwise unsupported ceilings.

SUMMARY OF THE INVENTION

In view of the foregoing, an object of this specification is to disclose a T-block attachment with a magnetized bolt for (first) securing a plastic sheet or curtain to the mount and (second) securing the mount to a metallic grid of a paneled sealing. In a first embodiment, the T-block features a stem and two arms wherein the stem includes a pole receptacle and each arm includes both a clip receptacle and a bolt receptacle. In operation: to Step 1-*a* standard broom pole or other extendable pole with a threaded tip may be coupled to the stem of the T-block partition mount; Step 2—a plastic sheet or curtain may be secured to the T-block partition mount via puncturing the sheet material with the bolt of a magnet bolt and then coupling the bolt to the bolt receptacle of the T-block partition mount such is that the sheet material is sandwiched between an arm of the T-block partition mount and the magnet of the magnetic bolt; and, Step 3—the T-block partition mount may be secured to a metallic structure of a ceiling such that the pole is extended downward from the sealing while the plastic sheet or curtain is secured to the ceiling via the magnets of the mount. In an alternative embodiment, Step 3 may involve securing the mount to a foot and then pressing the foot against the ceiling via a compression spring such that the pole is upright between the floor and the ceiling while the plastic sheet or curtain is secured to the ceiling beneath the foot. Suitably, the block may feature a wire clip for securing wires to the ceiling structure via the magnetic bolts.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 1B is another bottom perspective view of a T-block partition mount 1000 with rounded or truncated corners and edges;

FIG. 2B is a dimensional front view of the T-block partition mount 1000;

FIG. 3B is a dimensional bottom view of the T-bock partition mount 1000;

Figure 1A:
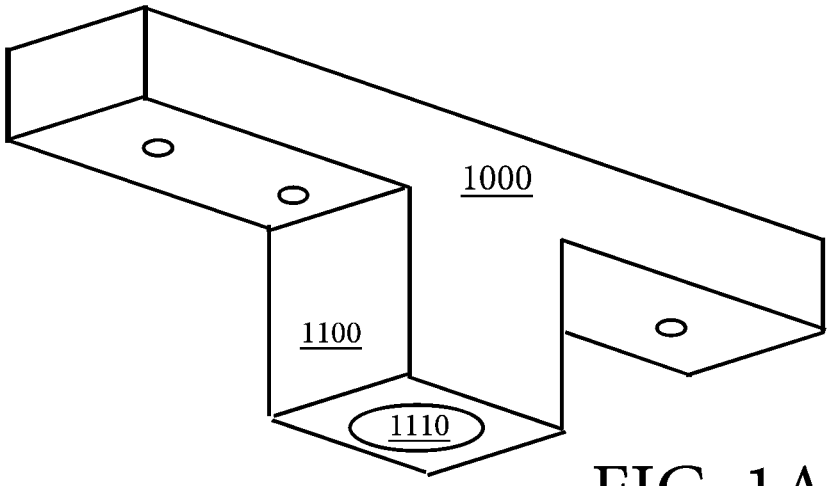
FIG. 1A is a bottom perspective view of a T-block partition mount 1000.

In the drawings, the following reference numerals are and indication of the corresponding component or part of the disclosed device:

1000—T-block partition mount
- 1100—stem
  - 1110—pole receptacle
- 1200—arm
  - 1210—clip receptacle
  - 1220—bolt receptacle
- 1300—foot

2000—magnet bolt
- 2100—magnet
- 2200—bolt

3000—wire clip
- 3100—Velcro® strap

4000—upright support pole
- 4100—pole
  - 4110—threads
- 4200—plunger
  - 4210—suction cup
  - 4220—sleeve
  - 4230—spring

5000—plastic sheet or curtain.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a T-block partition mount with a magnetized bolt for (first) securing a plastic sheet or curtain to the mount and (second) securing the mount to a metallic grid of a paneled sealing. Suitably, the block may feature a wire clip for securing wires to the ceiling structure via the magnetic bolts. Other details of the disclosed T-block partition mount are to described below with reference to the attached figures.

Figure 2A:
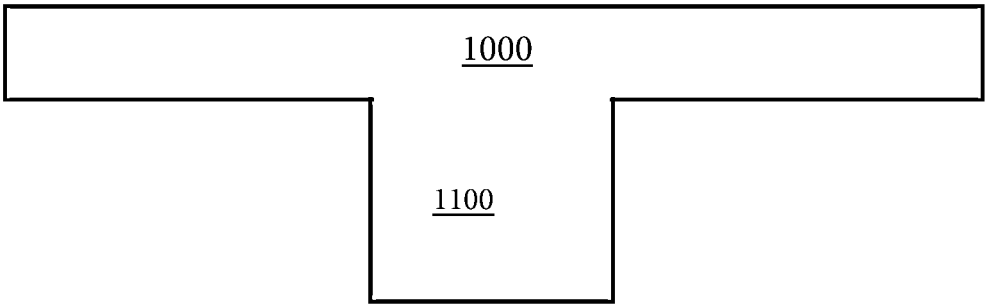
FIG. 2A is a front view of the T-block partition mount 1000.
Figure 3A:
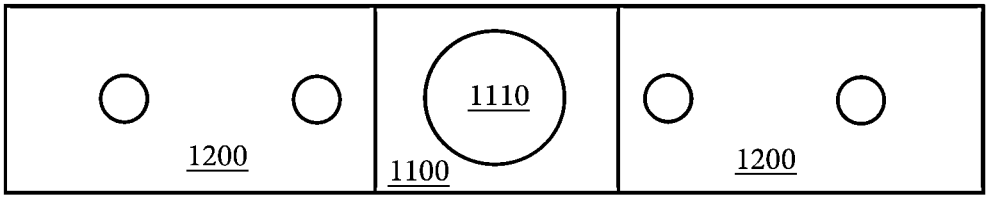
FIG. 3A is a bottom view of the T-bock partition mount 1000.
Figure 4:
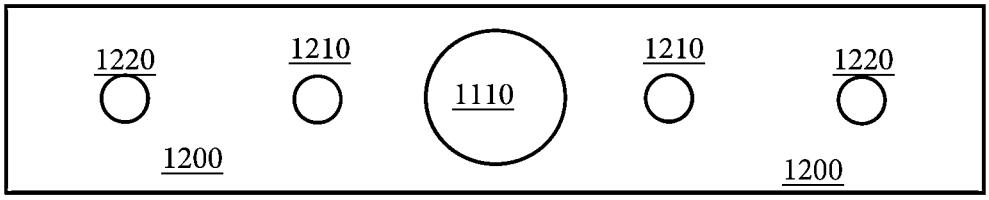
FIG. 4 is a top view of the T-block partition mount.

FIG. 1A is a bottom perspective view of a T-block partition mount 1000. FIG. 2A is a front view of the T-block partition mount 1000. FIG. 3A is a bottom view of the T-bock partition mount 1000. FIG. 4 is a top view of the T-block partition mount. As shown, the T-block is generally defined by is a T-shaped structure with a stem 1100 and two arms 1200. Suitably, each arm 1200 includes a bolt receptacle 1220 and a clip receptacle 1210 that have female or internal threads for receipt of a bolt capable of affixing a magnet or clip to the arm 1200. See e.g., FIGS. 5,6 and 8 discussed in greater detail below. In one embodiment, the stem 1100 features a pole receptacle 1110 that preferably includes female or internal threads capable of cooperating with the male or external threads of a standard broom pole or extension pole (not shown). Preferably, the threads of the pole receptacle are ACME (Standard) Threads or European Thread, which are typic of nearly all broom or brush pole ends. In the most preferred embodiment, ACME threads are provided the receptacle 1110 for use on any standard extension pole with a standard male threaded end (e.g., ¾ inch in diameter with 5 threads per inch). Threaded block attachment to accommodate most threaded handles for extension poles. This universal threaded block size ( ) allows for attachment of different attachments for the to purpose of affixing poly sheeting or other suitable materials for construction of temporary or semi-permanent barriers in maintaining dust barriers.

FIG. 1B is another bottom perspective view of a T-block partition mount 1000 with rounded or truncated corners and edges. FIG. 2B is a dimensional front view of the T-block partition mount 1000. FIG. 3B is a is dimensional bottom view of the T-bock partition mount 1000. Suitably, the T-block partition mount is fabricated as an integral unity out of 6061 aluminum. Suitably, the edges and corners of the T-block partition mount 1000 are suitably rounded or truncated to that the edges and corners are not sharp and pointed.

Figure 5:
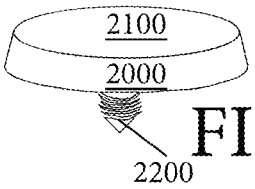
FIG. 5 is a perspective view of a magnet bolt 2000.

FIG. 5 is a perspective view of a magnet bolt 2000. As shown, the magnet bolt features a magnet 2100 and a bolt 2200 with a sharp point. As discussed in greater detail below, the bolt 200 may be used to puncture a plastic sheet or curtain so that the plastic sheet or curtain may be secured to the T-block partition mount 1000 via securing the bolt through the sheet or curtain and into the bolt receptacle. See e.g. FIGS. 8 through 11. In a preferred embodiment, the whole upper surface of the bolt 2000 is magnetized or is a magnet with sufficient magnetic force to hold the plastic sheet or curtain overhead. In a preferred embodiment the magnet is to neodymium.

Figure 6:
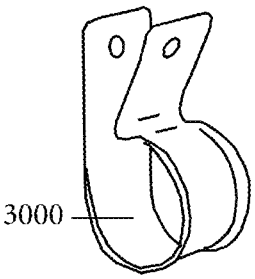
FIG. 6 is a perspective view of a wire clip 3000.

FIG. 6 is a perspective view of a wire clip 3000. As shown, the wire clip 3000 may be secured to the clip receptacle 1210 of each arm 1200 of a T-block partition mount (see FIG. 8). Suitably, the wire clip 3000 may be used to secure wires to the mount 1000 either via providing the wires is through the clip 3000 directly or via use of a Velcro® strap (i.e., strap with hook and loop connectors). See, e.g., FIGS. 8 and 9 (wires not shown).

Figure 7:
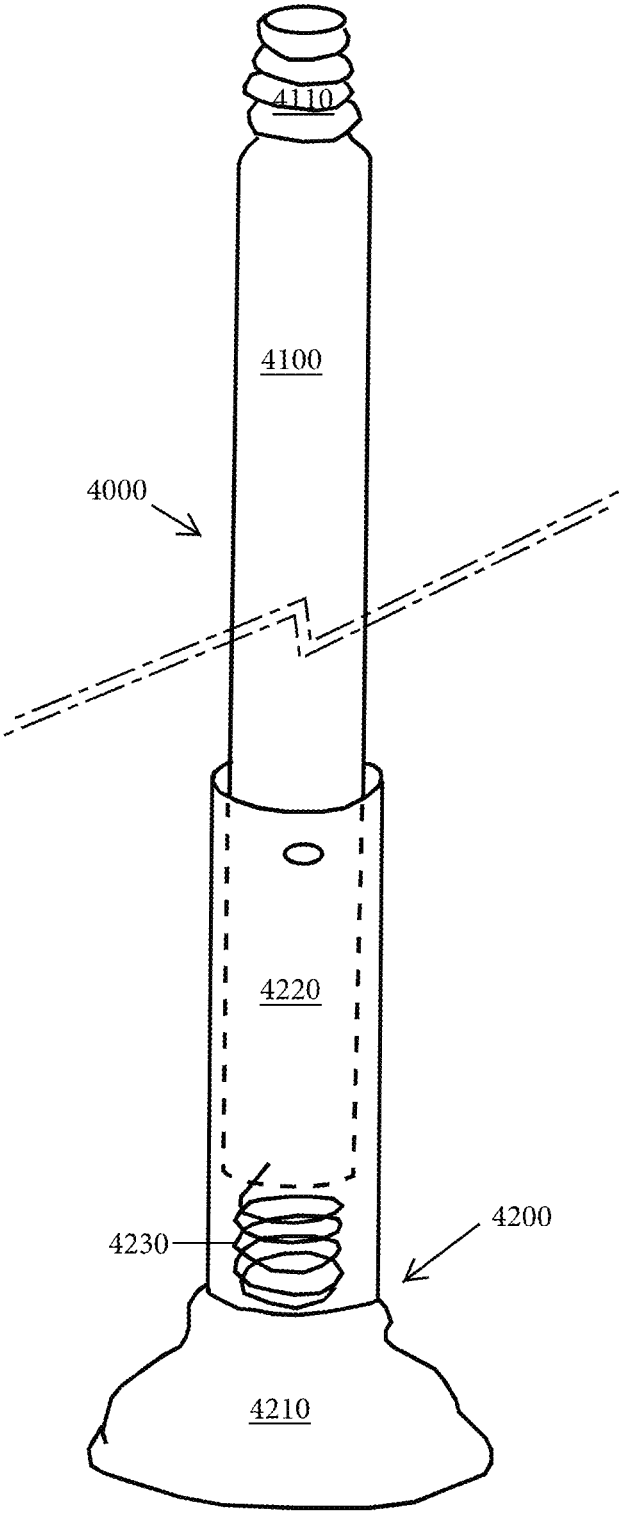
FIG. 7 is a perspective view of an upright support 4000.

FIG. 7 is a perspective view of an upright support 4000. As shown, the upright support pole 4000 comprises a pole 4100 with male threads 4110 at the tip and a butt that has been provided into a sleeve 4220 of a plunger 4200. Suitably, the sleeve 4220 (A) contains a spring 4230 for biasing the pole 4100 toward the outside of the sleeve 4220 and (B) is provided with a suction cup 4210 for securing the sleeve 42200 to the ground or other suctionable surface.

Figure 8:
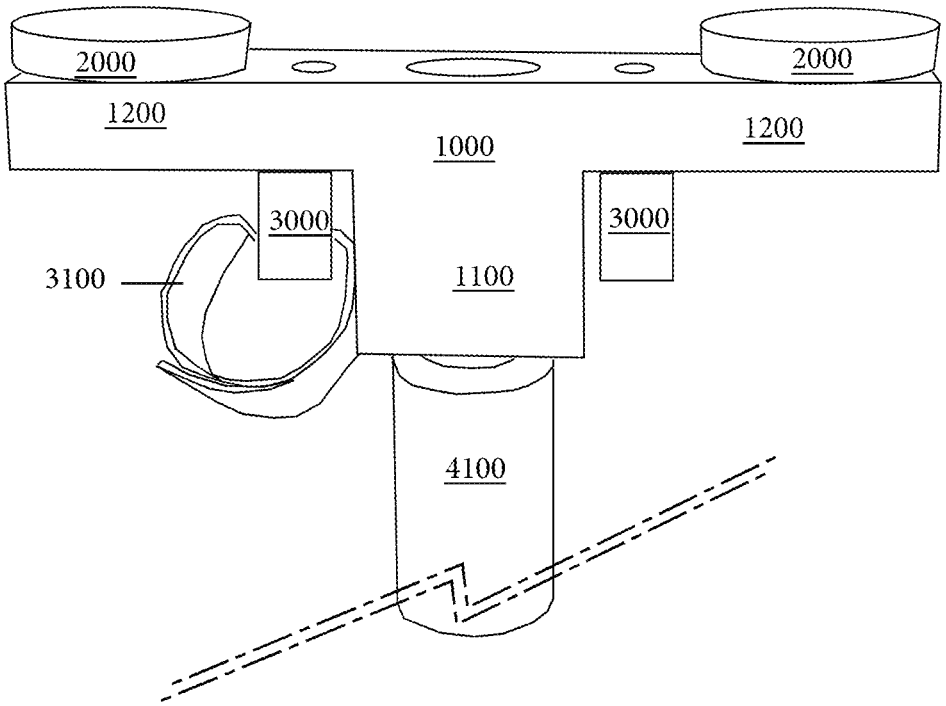
FIG. 8 is an assembled view of the T-block partition mount.

FIG. 8 is an assembled view of the T-block partition mount. As shown a pole 4100 is provided to the pole receptacle 1110 of the stem 1000. As is further shown, a wire clip 3000 with a Velcro® strap is proved to the clip receptacle 1210 of the arm 1220, and magnet bolts 2000 are provided to the bolt receptacle. Suitably, a fully assembled T-block partition mount 1000 is defined in the depicted configuration.

Figure 9:
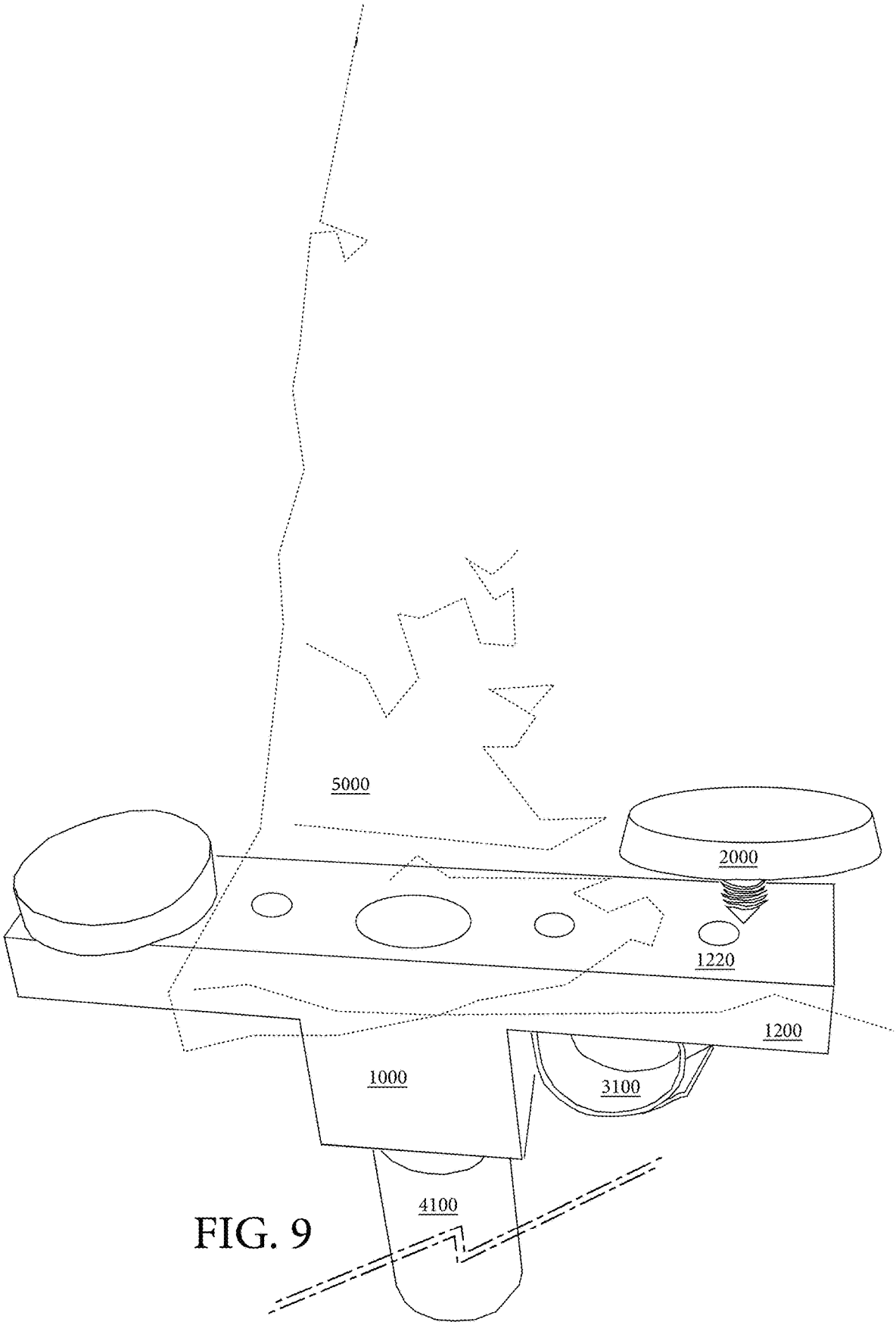
FIG. 9 is an environmental or contextual view of the T-block partition mount 1000 being secured to a plastic sheet or curtain 5000 via the magnet bolt 2000.

FIG. 9 is an environmental or contextual view of the T-block partition mount 1000 being secured to a plastic sheet or curtain 5000 via the magnet bolt 2000. As shown, a plastic sheet or curtain 5000 may be secured to the T-block partition mount 1000 via puncturing the sheet material 5000 with the sharp tip of the bolt 2200 of a magnet bolt 2000 and then coupling the is bolt 2200 to the bolt receptacle 1220 of the T-block partition mount's arm 1200. In a suitable assembly, the sheet material 5000 is sandwiched between an arm 1200 of the T-block partition mount 1000 and the magnet 2100 of the magnetic bolt 2000. See, e.g., FIG. 10A-11.

Figure 10A:
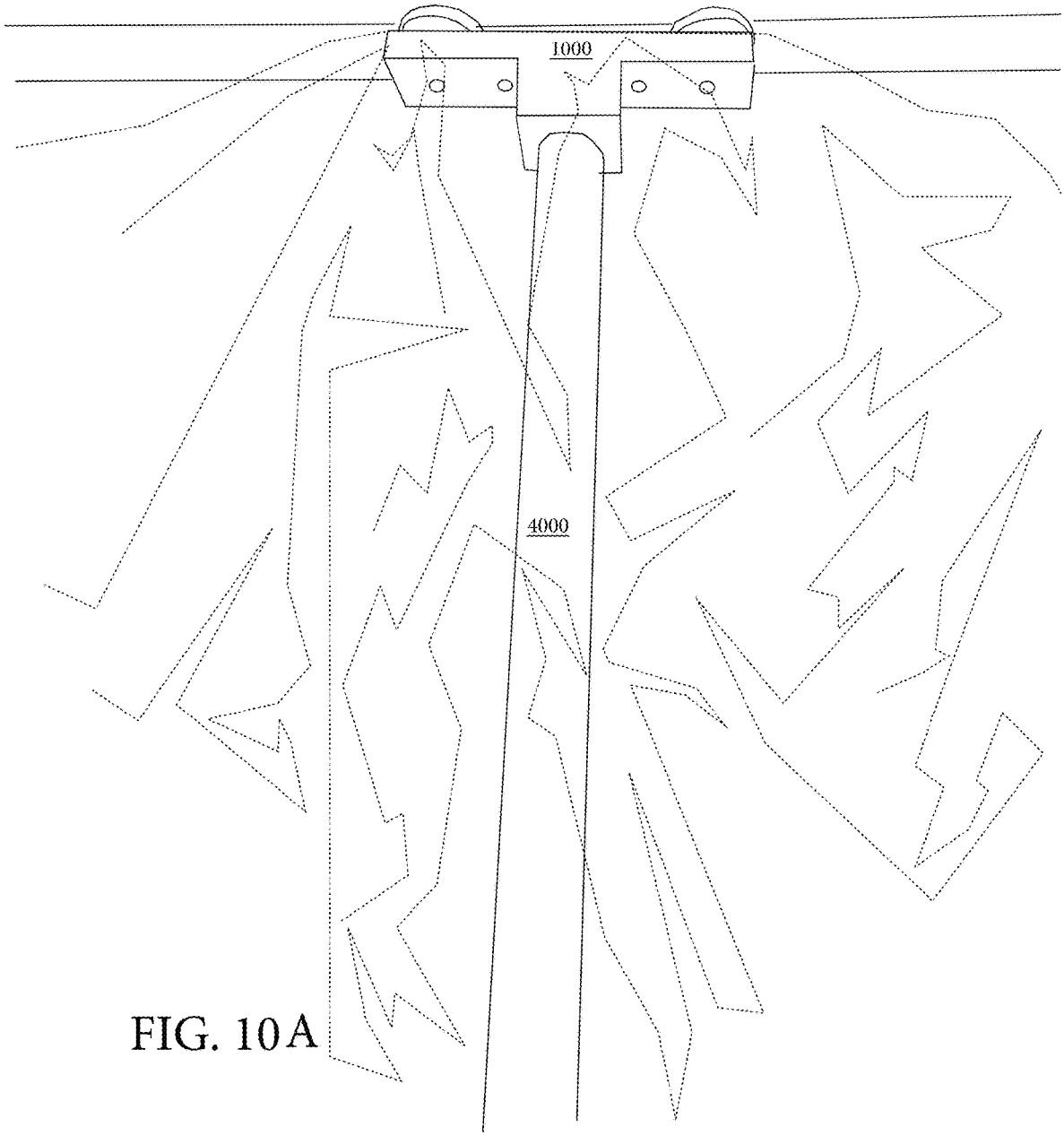
FIG. 10A is an environmental or contextual view of the T-block partition mount 1000 hanging a plastic sheet or curtain 5000 to a metal cross-bar of a grid system of a paneled ceiling.
Figure 10B:
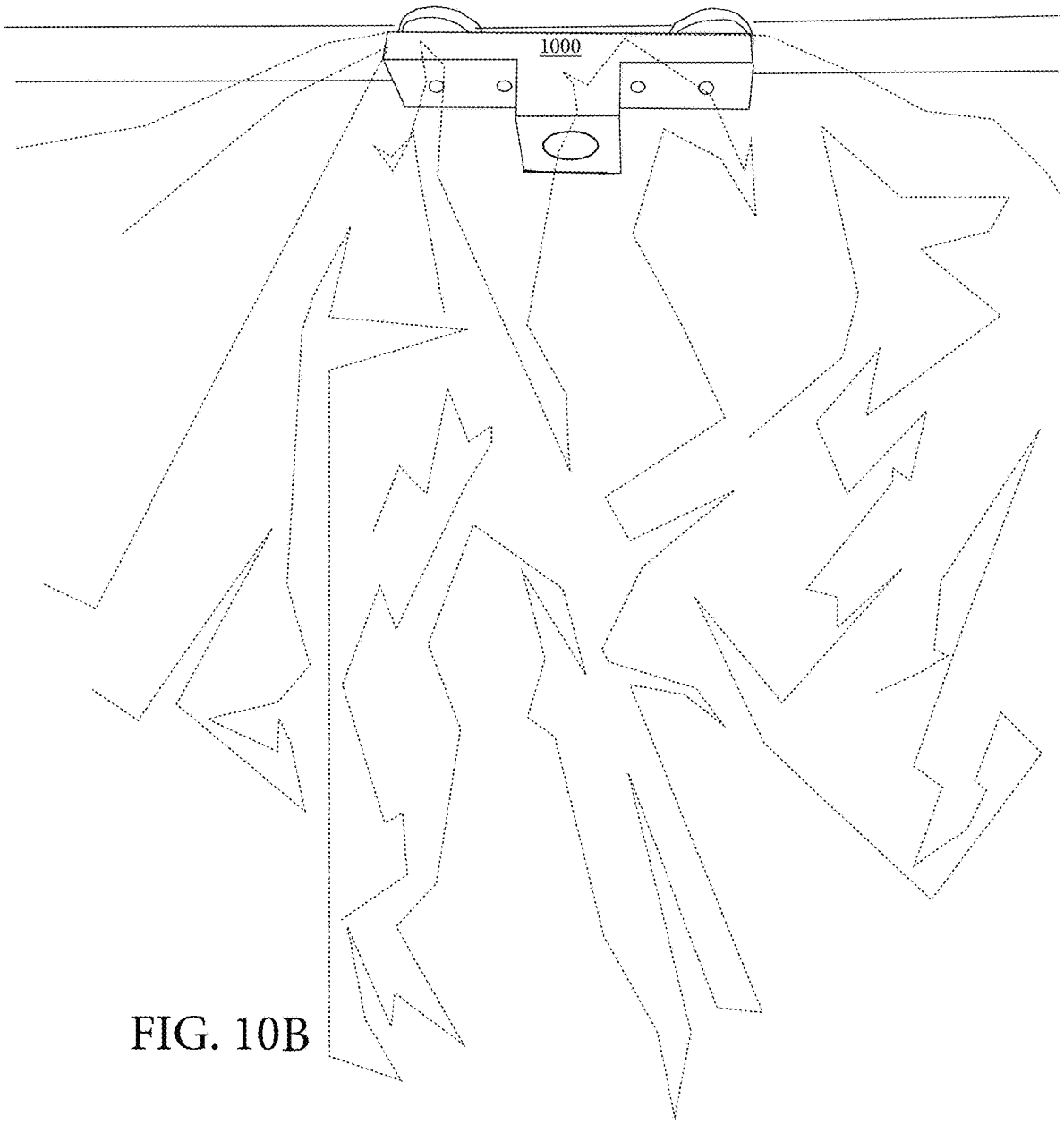
FIG. 10B is another environmental or contextual view of the T-block partition mount 1000 hanging a plastic sheet or curtain 5000 to a metal cross-bar of a grid system of a paneled ceiling; and, FIG. 11 is an environmental or contextual view of the T-block partition mount 1000 hanging a plastic sheet or curtain 5000 to a nonmetal ceiling or is other non-metal overhead structure.

In operation: Step 1-*a* standard broom pole 4100 or other extendable pole with a threaded tip 4110 may be coupled to the stem 1100 of the T-block partition mount 1000; Step 2—a plastic sheet or curtain 5000 may be secured to the T-block partition mount 1000 via puncturing the sheet material 5000 with the bolt 2200 of a magnet bolt 2000 and then coupling the bolt 2200 to the bolt receptacle 1220 of the T-block partition mount 1000 such that the sheet material 5000 is sandwiched between an arm 1200 of the T-block partition mount 1000 and the magnet 2100 of the magnetic bolt 2000; and, Step 3—the T-block partition mount 1000 may be secured to a metallic structure 6000 of a ceiling such that the pole 4100 is extended downward from the sealing while the plastic sheet 5000 or curtain to is secured to the ceiling via the magnets 2100 of the mount. FIG. 10A is an environmental or contextual view of the T-block partition mount 1000 hanging a plastic sheet or curtain 5000 to a metal cross-bar of a grid system of a paneled ceiling. FIG. 10B is another environmental or contextual view of the T-block partition mount 1000 hanging a plastic sheet is or curtain 5000 to a metal cross-bar of a grid system of a paneled ceiling. As shown in FIGS. 10A-10B, the pole 4100 may be removed from the mount 1000 after the mount 1000 has been secured to the metallic grid of the ceiling panel.

Figure 11:
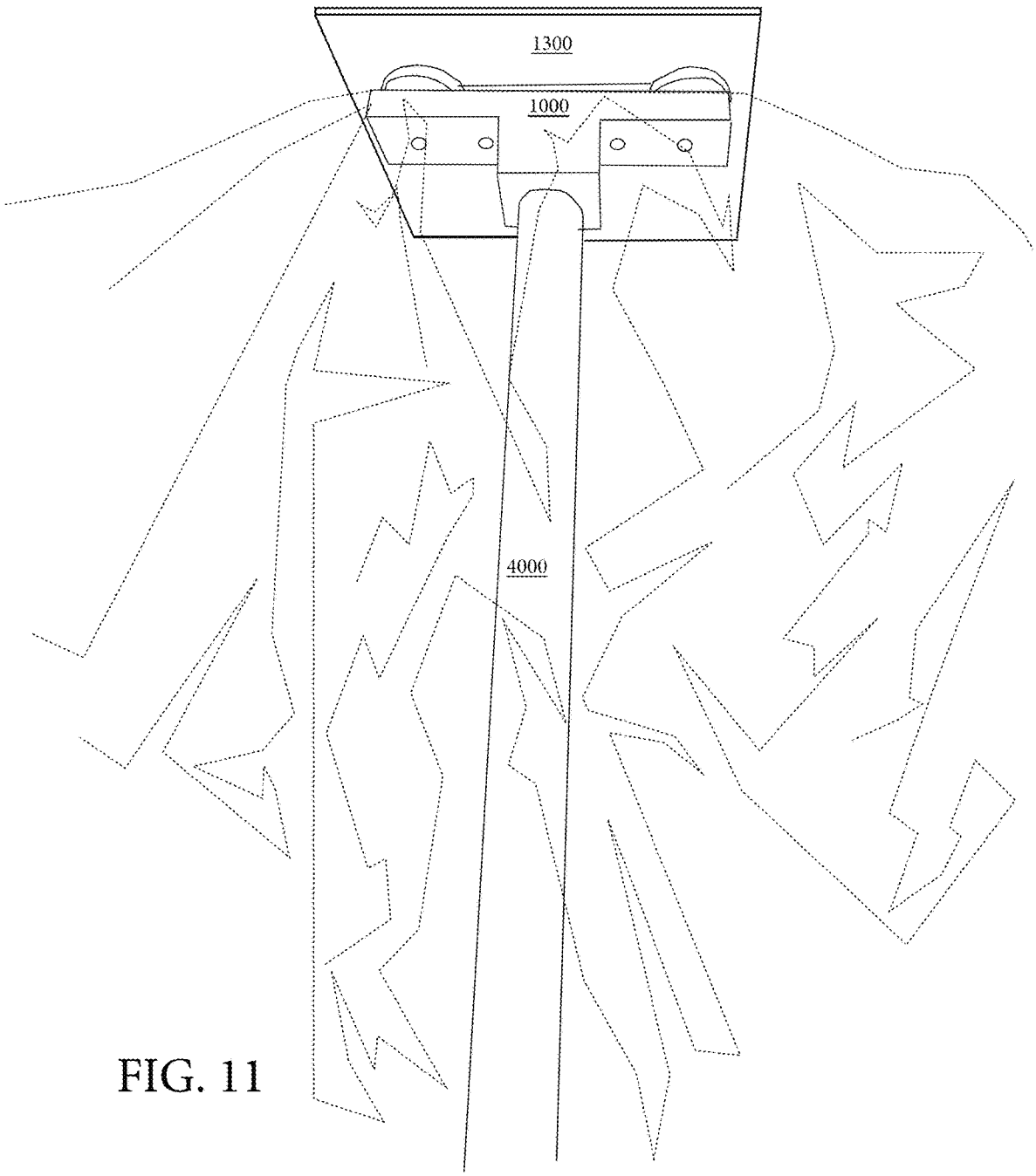

In an alternative embodiment, Step 3 may involve securing the mount to a foot and then pressing the foot against the ceiling via a compression spring such that the pole is upright between the floor and the ceiling while the plastic sheet or curtain is secured to the ceiling beneath the foot. FIG. 11 is an environmental or contextual view of the T-block partition mount 1000 hanging a plastic sheet or curtain 5000 to a nonmetal ceiling or other non-metal overhead structure. FIG. 7 is a perspective view of an upright support 4000. As taught by FIGS. 11 and 7, a partition framework may be established in a room with does not have a ceiling with a metallic structure via applying a foot 1300 to the mount 1000 and then pressing the foot 1300 against the ceiling via a compression spring 2300. In a preferred embodiment, the pole 4100 may be suitably anchored to the ground via the suction cup 4210.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might is be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of establishing a partition comprising the steps of:

coupling a standard broom pole or other extendable pole with a threaded tip to a stem of a T-block partition mount;

securing a plastic sheet or curtain to the T-block partition mount via puncturing the plastic sheet or curtain with a bolt of a magnet bolt and then coupling the bolt to a bolt receptacle of the T-block partition mount such that the plastic sheet or curtain is sandwiched between an arm of the T-block partition mount and a magnet of the magnetic bolt;

securing the T-block partition mount to a metallic structure of a ceiling such that the pole is extended downward from the ceiling while the plastic sheet or curtain is secured adjacent to the ceiling via the magnet of the magnetic bolt; and, uncoupling the standard broom pole or other extendable pole with the threaded tip from the stem of the T-block partition mount while the plastic sheet or curtain remains secured adjacent to the ceiling via the magnets of the mount.

2. The method of claim 1 further comprising the step of securing a wire to the T-block partition mount via a clip that was secured to a clip receptacle.

* * * * *